United States Patent [19]

Cox et al.

[11] 4,390,195

[45] Jun. 28, 1983

[54] VEHICLE LOCKING MECHANISM

[76] Inventors: Walter T. Cox, 95 Nancy Dr.; Edward F. Tannery, 14537 Iyopawa Island, both of Coldwater, Mich. 49036

[21] Appl. No.: 236,839

[22] Filed: Feb. 23, 1981

[51] Int. Cl.[3] ..... E05C 3/22

[52] U.S. Cl. ..... 292/53; 292/221; 292/DIG. 27

[58] Field of Search ..... 292/53, 221, DIG. 27, 292/DIG. 26, 30, 127, 35, 216, 280

[56] References Cited

U.S. PATENT DOCUMENTS

| | | | |
|---|---|---|---|
| 2,096,980 | 10/1937 | Schjolin | 292/53 |
| 2,636,765 | 4/1953 | Dall | 292/216 |
| 2,683,617 | 7/1954 | Roethel | 292/DIG. 27 X |
| 2,993,360 | 7/1961 | Craig | 292/DIG. 26 X |
| 3,608,941 | 9/1971 | Kondo | 292/DIG. 27 X |
| 3,650,554 | 3/1972 | Tharp | 292/127 |
| 3,784,241 | 1/1974 | Pickles | 292/DIG. 26 X |
| 4,312,527 | 1/1982 | Tannery | 292/49 |

FOREIGN PATENT DOCUMENTS

| | | | |
|---|---|---|---|
| 698599 | 10/1953 | United Kingdom | 292/DIG. 26 X |

*Primary Examiner*—Thomas J. Holko
*Assistant Examiner*—R. Illich
*Attorney, Agent, or Firm*—McCaleb, Lucas & Brugman

[57] ABSTRACT

Locking mechanism having a casing including a pair of spaced support plates of similar size and shape. The support plates have identical, spaced, congruent, T-shaped tongues along their front edges. When installed in a door, the tongues extend beyond the edge to engage a strike in the door frame. A pair of bolt members are pivoted in the space between the support plates and are movable between an extended, closed position engaging the strike to a retracted, open position not engaging the strike. A slide rod engages the bolt members and is rotatably and reciprocally journaled between the plates. The slide rod has a transverse arm portion adapted to be connected to one or more manual locking elements in the vehicle door to turn the rod between locked and unlocked mode positions. A slide actuator lever is pivoted to the casing and is engageable with the slide rod arm portion to turn it between locked and unlocked mode positions. A bolt actuator member is pivotably supported in the space between the support plates and is adapted to be connected to manual opening elements on the inside and outside of the door. The slide rod has an intermediate offset portion. When the slide rod is turned to its unlocked mode position, the offset portion thereof is engageable by the bolt actuator member to move the bolt members to their open position. When the slide rod is turned to its locked mode position the offset portion thereof is not engageable by the actuator member, thereby disabling the slide rod from moving the bolt members to open position when the actuator member is moved.

12 Claims, 11 Drawing Figures

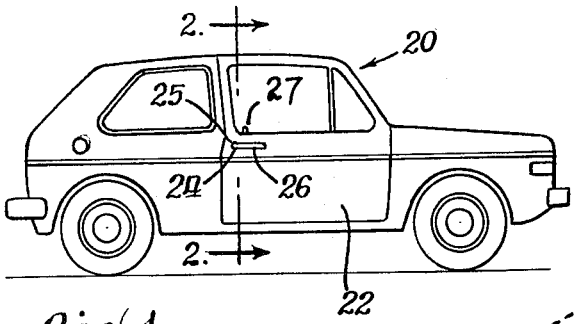
Fig. 1.
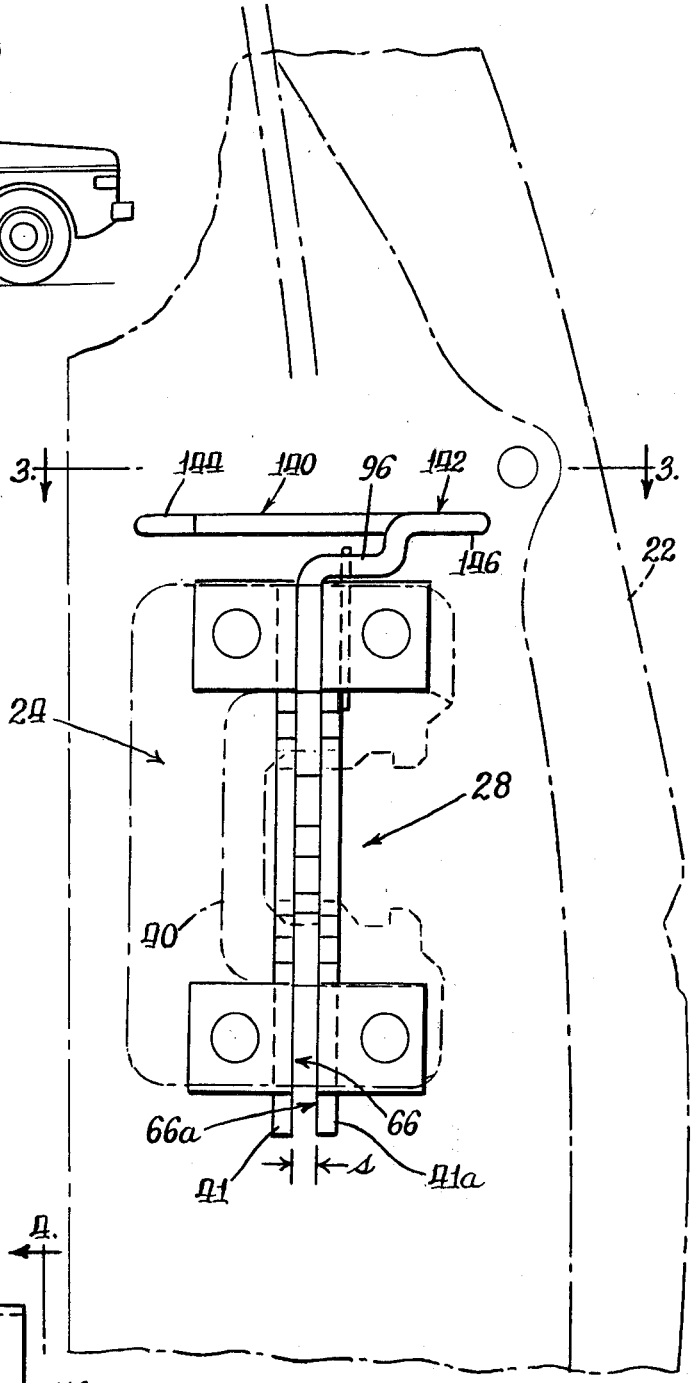
Fig. 2.
Fig. 3.
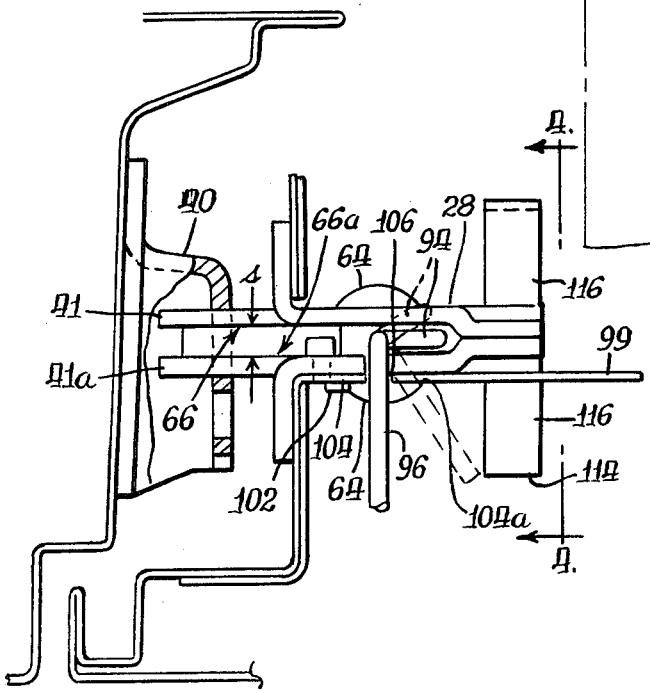

VEHICLE LOCKING MECHANISM

BACKGROUND OF THE INVENTION

This invention belongs to the field of locking mechanisms, particularly the kind used for vehicles which must be extremely compact and secure to hold a closure such as a door or hatch closed while the vehicle is motion.

There are special requirements for motor vehicle doors, hatches and trunk lids. They are thin, making it impractical to use locks and latches designed for relatively thicker, stationary building structures. Further, the possibility of injury and property damage due to accidental opening while a vehicle is in motion is not present in buildings and requires positive locking security far beyond that required in a building structure. Yet, in spite of relatively costly locking mechanisms made to comply with special safety requirements for vehicles, people continue to be killed or injured and their property lost or damaged by falling out of moving vehicles when doors, hatches and trunk lids open accidentally. Accordingly, this situation is in need of improvement.

SUMMARY OF THE INVENTION

It is a general object of the present invention to provide, for a vehicle, a locking mechanism which is simple and inexpensive yet will hold a door, hatch or lid securely closed while in motion despite vibration, racking and warpage of the closure or its frame.

A broad object is to provide an improved locking mechanism including a pair of bolt members spring-urged in opposite directions into mating slots in a strike, the locking mechanism having an elongated slide member which is longitudinally movable to open the bolt members and is transversely movable in one direction to an unlocked mode position enabling a bolt actuator member to move the slide member to open the bolt members, and is transversely movable in the opposite direction to a locked mode position disabling the bolt actuator member from moving the slide member to open the bolt members.

Another object is to provide such a locking mechanism in which the bolt members are interconnected for simultaneous movement and the slide member and one of the bolt members are interconnected whereby movement of the slide member moves both bolt members simultaneously.

Another object is to provide such a locking mechanism in which spring means acts on the bolt members indirectly through the slide member enabling a single spring means to be effective on both bolt members and the slide member.

Another object is to provide such a locking mechanism in which the slide member comprises an elongated rod member which is journaled for both longitudinal and rotatable movement.

Another object is to provide such a locking mechanism in which the elongated slide rod member has an offset portion which is transversely movable upon rotation of the slide rod member for engagement with the bolt actuator member in unlocked mode position and non-engagement therewith in locked mode position.

Another object is to provide such a locking mechanism in which the slide rod member has a transverse arm position for connecting it to a manual locking element and the bolt actuator member has a separate arm for connecting it to a manual actuating element.

Another object is to provide such a locking mechanism in which the bolt members, slide rod member, and bolt actuator member are coplanar with one another within a space between casing support plates, and at least one of the plates has an opening alongside the offset portion of the slide rod member to receive the offset portion when the rod member is rotated to locked mode position.

Another object is to provide such a locking mechanism in which the offset portion of the slide rod member is rotated out of engagement with the bolt actuator member only when the slide member is in locked mode position and the bolt members are in closed position.

Another object is to provide such a locking mechanism in which the casing support plates have mutually facing inner, parallel surfaces which restrain the offset portion of the slide rod member from rotation, while enabling longitudinal movement, when the slide rod member is in unlocked mode position and the bolt members are in open position.

Another object is to provide such a locking mechanism in which the bolt actuator member includes a flat, blade-like element pivotally connected to the casing in the space between the two support plates.

Another object is to provide such a locking mechanism in which the slide rod member has a transverse arm portion guided within a guide slot in the casing to prevent rotation of the slide rod member while the bolt members are in open position.

Another object is to provide such a locking mechanism in which the transverse arm portion of the slide rod member is out of engagement with the guide slot when the slide rod member is in a position corresponding to the closed position of the bolt members.

BRIEF DESCRIPTION OF THE DRAWINGS

Other objects and advantages will be apparent from the following description taken in connection with the drawings in which:

FIG. 1 is one example of a vehicle in which the door lock assembly of the present invention may be advantageously used;

FIG. 2 is an enlarged fragmentary vertical sectional view of FIG. 1 taken generally along the line 2—2, showing the door lock assembly in the swinging edge of the vehicle door;

FIG. 3 is a fragmentary horizontal cross-sectional view of FIG. 2, taken along line 3—3;

DETAILED DESCRIPTION OF THE PREFERRED EMBODIMENT

Figure 4:
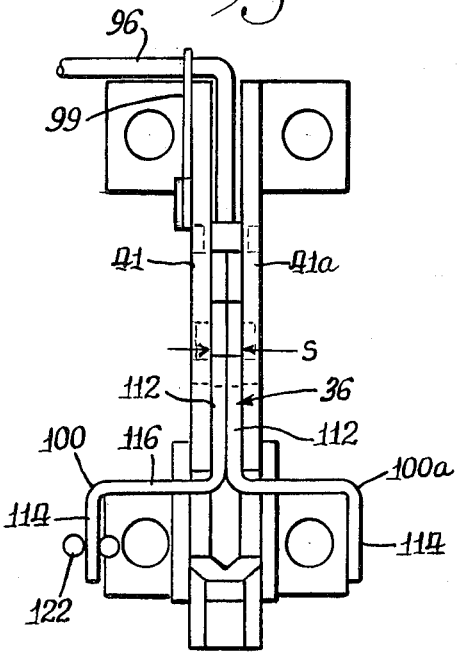
FIG. 4 is a vertical end view of the door lock assembly as seen in the direction of arrows 4—4 in FIG. 3.

Referring now more specifically to the invention shown in the drawings, a vehicle 20 has a door 22 with a locking mechanism generally designated 24 which is shown in more detail in the subsequent figures. A door handle 26 is on the outside of the door and a counterpart handle (not shown) will be inside the door. A cylinder door lock 25 controlled by a key and an inner lock button 27 will be provided in the door. The door on the opposite side of FIG. 1 will likewise be provided with outer and inner door handles and lock hardware. These may be conventional and will not be described in detail.

The locking mechanism 24 has a casing generally designated 28 which supports a pair of bolt members 30 and 32, a slide rod member 34, a slide actuator member 99, a bolt actuator member 36, a spring 38, and a strike plate 40.

Figure 9:
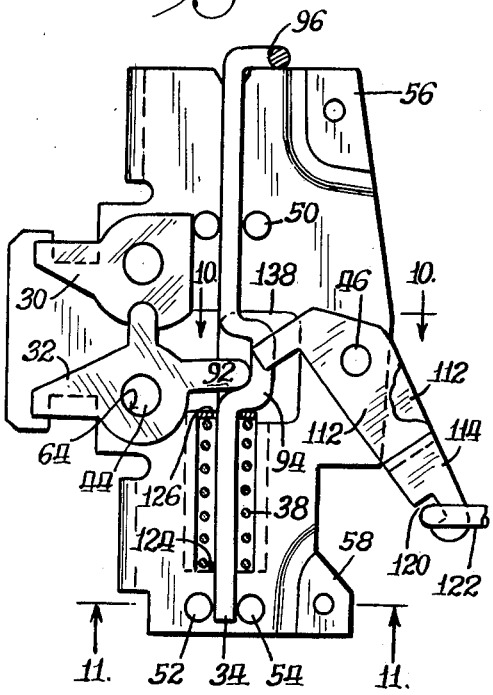
FIG. 9 is an internal view similar to FIG. 6 showing the door lock assembly in locked mode and closed position.
Figure 11:
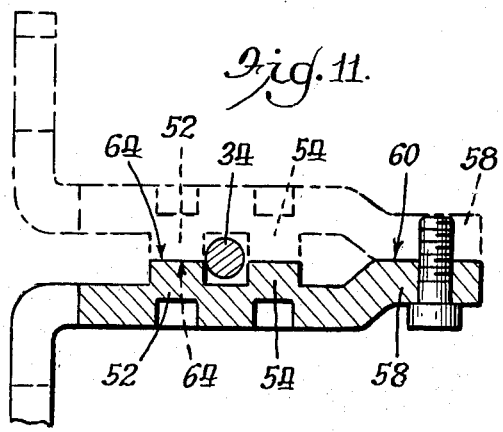
FIG. 11 is a sectional view of FIG. 9 taken on line 11—11.

The casing 28 comprises a pair of similar-shaped support plates 41 and 41*a* which are substantial mirror images of one another. Each has inwardly-indented, circular cross-section bosses 42, 44 and 46 which register with counterpart bosses in the other plate to form pivots for the two bolt members 30, 32 and the bolt actuator member 36. Two pair of inwardly-indented circular cross-section bosses 48, 50 and 52, 54 provide guides for the slide member 34 enabling it to shift longitudinally and to turn about its own axis. As best shown in FIGS. 9 and 11, each support plate has a pair of inwardly-indented corner portions 56 and 58 which have inner surfaces 60 coplanar with inner surfaces 64 at the ends of the bosses 42, 44, 46, 48, 50, 52 and 54. The two support plates may be assembled in any convenient way, for example by rivets, screws or by flash welding which fuses the ends of the pairs of bosses.

Each casing support plate 41, 41*a* has a semi-cylindrical pocket 64 for the spring 38, the purpose and function of which will be described later. Alternatively, a pair of openings (not shown) in the plates 41, 41*a* may be provided to make room for the spring.

The support plates 41, 41*a* are held apart a predetermined amount by the bosses 42–54 and by the corner portions 56 and 58 described above. The support plates have mutually facing inner, parallel surfaces 66, 66*a* defining a space s (FIGS. 2 and 3) therebetween. These surfaces provide constraining guidance for the bolt members 30, 32, the slide rod member 34, and bolt actuator member 36 as will be described. The support plates 41, 41*a* have identical, spaced, congruent, T-shaped tongues 68, 68*a* along front edges adapted to extend outwardly beyond the swinging edge of the door into the strike 40. Each tongue comprises a central stem 70 and a wider head 72 at the extreme outer end, defining recesses 74, 76 under opposite (top and bottom) ends of the head.

Figure 6:
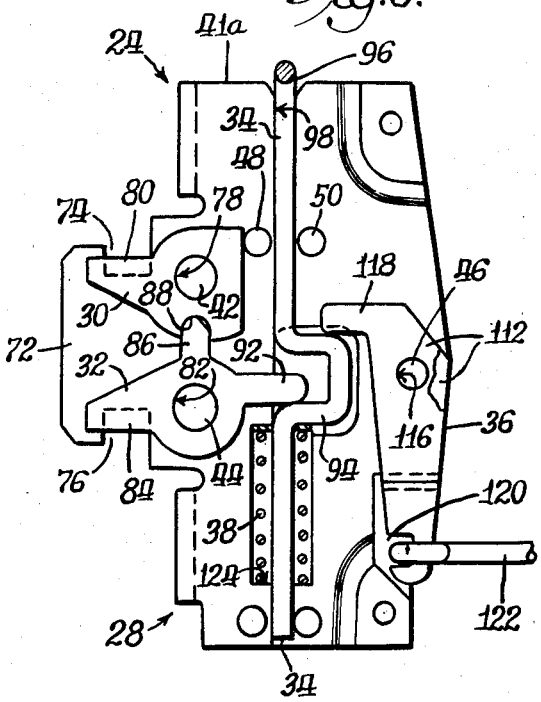
FIG. 6 is a vertical internal view of the door lock assembly in unlocked mode and closed position.

As shown in FIG. 6, bolt member 30 has a central opening 78 pivotally journaling it about the pair of aligned bosses 42, 42, and it has a latch portion 80 which extends in the closed position into recess 74 beneath the heads 72. Similarly, bolt member 32 has a central opening 82 pivotally journaling it about aligned bosses 44, 44, and it has a latch portion 84 which extends in the closed position into recess 76 beneath the head. In the unlocked mode open position (FIG. 7), both latch portions 80 and 84 are contracted into the space s between central stem portions 70, 70.

The two bolt members are interlocked for simultaneous pivotal movement between their closed and open positions. Specifically, in the present instance, this interconnecting means comprises a radial tooth 86 extending from bolt member 32 into a peripheral notch 88 in bolt member 30. Bolt member 32 has a backwardly extending arm 92 which extends into the hollow side of the slide member offset portion 94 and is engageable by that offset portion, as will be described.

Directing attention now to the slide member 34, it is here shown as a rod which is supported between the plates 41, 41*a* and between the pairs of bosses 48, 50 and 52, 54. By this construction, the slide rod member 34 is both longitudinally and rotatably journaled in the casing. It can reciprocably shift longitudinally, between the closed position of FIG. 6 to the open position of FIG. 7; and it can oscillatably shift rotatably from the unlocked mode position of FIGS. 3 and 5 to the locked mode position shown in broken lines in those two figures. It is formed with an intermediate offset, U-shaped portion 94 which engages the backwardly extending bolt member arm 92 as aforesaid, and its upper end has a transverse arm portion 96 guided within an end slot 98 which is parallel to the slide rod and both of the plates 41, 41*a*. A slide actuator 99 is one form of actuator for rotating number 34. It comprises a lever pivoted on a pin 102 fastened to support plate 41. Alternatively, it may be pivoted in some part of the door separate from the lock mechanism. It has a pair of transverse vertical arms 104, 104*a* with a space 106 therebetween engaging the slide arm portion 96. Detents 108, 108*a* acting between the arm 99 and the plate 41 hold the arm 99 in the unlocked and locked positions shown in solid and broken lines respectively in FIG. 5.

As an alternate to the slide actuator lever 99, the upper, actuatable end of the slide rod member 34 may be formed enabling it to be engaged from either side. It is here shown with opposite arms 140 and 142 terminating respectively in loops 144 and 146 for engagement by a suitable link (not shown), which extends to lock actuating elements or knobs in the door. One or the other of the loops will be connected to such a link depending on whether the mechanism is used in a right-hand or left-hand door.

Figure 7:
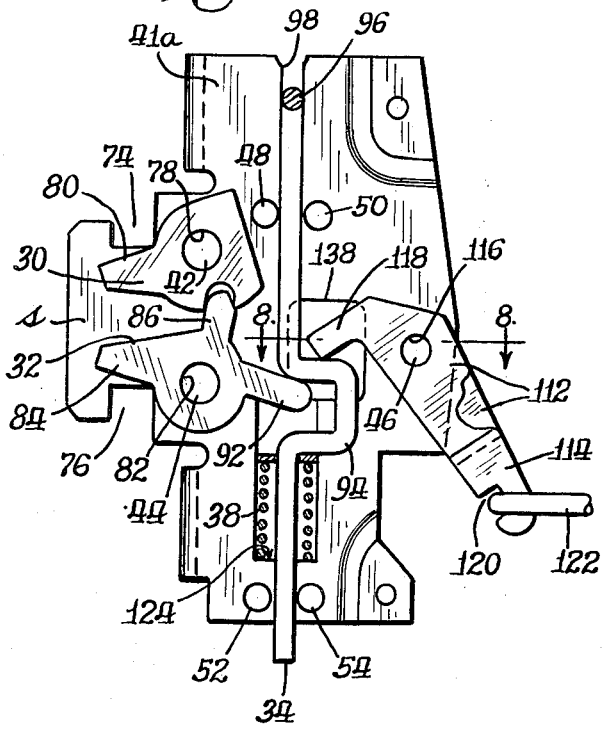
FIG. 7 is similar to FIG. 6 showing the assembly in unlocked mode and open position.
Figure 8:
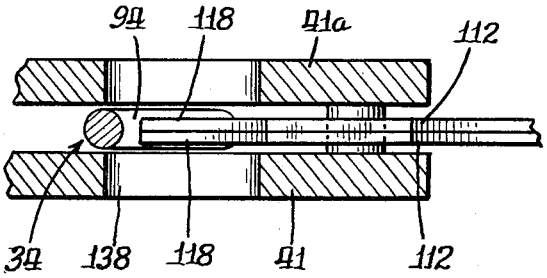
FIG. 8 is a fragmentary, horizontal sectional view of FIG. 7 taken on line 8—8.

The bolt actuator member 36 comprises a pair of similar-shaped actuator elements 100 and 100*a*. The side outline of these is shown in FIGS. 6, 8 and 11. The end configuration in FIG. 4 shows the individual elements to be generally Z-shaped, each having a flat, blade-like portion 112 in the space s between plates 41 and 41*a*. Each has a lever end portion 114 connected to the respective blade portion by a transverse section 116. The actuator elements 100, 100*a* may be suitably fastened together as by rivets or spot welding. As shown in FIGS. 6, 7 and 9, the actuator elements have central openings 116, 116 pivotally journaled about aligned bosses 46, 46. The blade portions 112 have cam-like extensions 118 engagable with the slide member offset portion 94. This engagement is best shown in FIGS. 6 and 7.

The separate offset lever end portions 114 have recesses 120 which provide alternate connecting points for a link 122 for right-door or left-door use. The link 122 extends (by means not shown) to internal and external door-opening handles. One such external door opening handle is designated 26 in FIG. 1. Alternatively, for the purpose of shifting the slide member 34 downwardly, the transverse arm portion 96 may be pressed in the direction of arrow 110 shown in FIG. 5 by an element not shown.

Figure 10:
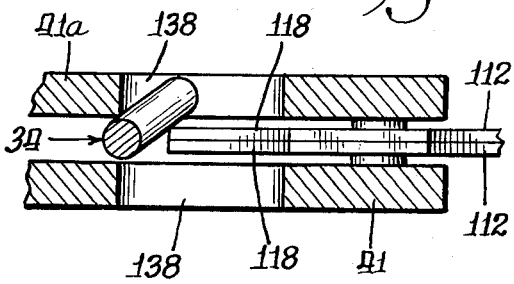
FIG. 10 is a fragmentary, horizontal view of FIG. 9 taken on line 10—10.

As best shown in FIGS. 6 and 8, the bolt members 30, 32 are in coplanar relationship within the space s between the support plates 41 and 41*a*. Further, the slide member offset portion 94 is coplanar with the bolt actuator member cam extensions 118 for engagement therewith in the unlocked mode as shown in FIGS. 6, 7 and 8. The slide member offset portion 94 is rotated out of the plane of the actuator member extensions 118 and therefore not engagable therewith, in the locked mode as shown in FIGS. 9 and 10.

The compression coil spring 38 is positioned in a cylindrical cavity consisting of the two semi-cylindrical pockets 64 described above. The bottom end of the spring is seated against the bottom end walls 124 of those semi-cylindrical pockets in the casing, and the top end of the spring is seated against washer 126 which bears against the slide member offset portion 94. Thus, the single spring 38 performs a multiplicity of functions: it urges the locking mechanism components to the normal position shown in FIG. 6, namely where the bolt members are closed, the slide rod member 34 is in its up position disengaged from slot 98, and bolt actuator member 36 is in its fully clockwise, rotated position.

The strike 40, and its manner of cooperating with the T-shaped tongues and pivotal bolts in the novel locking mechanism are described in detail in applicant's prior U.S. application Ser. No. 133,913 filed Mar. 25, 1980 entitled "Compact Ambidextrous Locking Mechanism" now U.S. Pat. No. 4,312,527. Reference may be had to that application for details. Briefly, however, the strike comprises a C-shaped plate attached to the vehicle frame opposite the locking mechanism. The latch portions 80 and 84 of the bolt members are engagable within pairs of sawtooth notches 128, 128 or 130, 130 in the strike. The recesses 74, 76 beneath the T-heads receive the upper and lower walls 130, 132 of the strike when the door is closed. The strike may be fastened to the door frame in any suitable manner as for example by screws 134 extending through openings 136 into the frame.

Use and operation of the locking mechanism is believed to be apparent from the foregoing description. Briefly, however, the spring 38 urges the locking mechanism components to the positions shown in FIG. 6. This is the unlocked mode, and the closed position of the bolt members. This is also shown in solid lines in FIGS. 3 and 5.

To open the bolt members preparatory to opening the door, the bolt actuator member 36 is rotated counterclockwise, as seen in the drawings, by link 122, to move slide member 34 downward to the position shown in FIG. 7 against the compression of spring 38. This opens the bolt members 30 and 32. This is also the dotted line position shown in FIG. 5.

Figure 5:
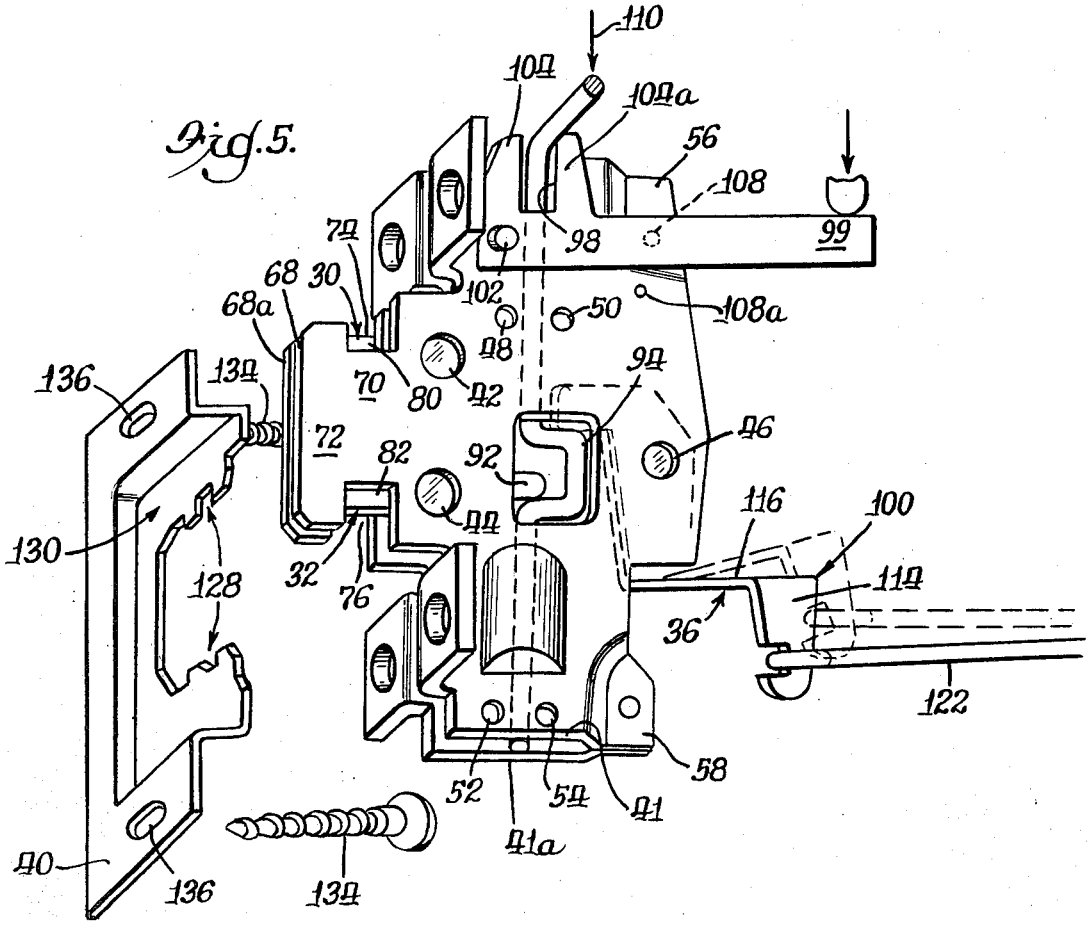
FIG. 5 is a perspective view of the door lock assembly illustrating locked and unlocked modes, both in closed position of the bolt members.

Alternatively, the slide member can be shifted downward by an element (not shown) exerting pressure on the arm 96 in the direction of arrow 110 (see FIG. 5). To lock the mechanism, the slide actuator 99 is moved downward from detent 108 to detent 108*a*. This rotates the slide member 34 counterclockwise (FIG. 3) from the solid line position to the broken line position of FIGS. 3 and 5. This is shown in solid lines in FIG. 9. This moves the slide member offset portion 94 in a direction transverse to the length of the slide member to the position shown in FIGS. 9 and 10, where it cannot be engaged by the actuator member extensions 118. Thus, in the locked mode, closed position (FIGS. 9 and 10), any attempt to open the bolt members 30, 32 by moving the bolt actuator member 36 results only in the actuator cam extensions 118 moving past the slide member offset portion 94 without moving the bolt members from their closed position.

Each of the support plates 41, 41*a* has a square opening 138 provided alongside the slide rod offset portion 94. When the mechanism is in locked mode, closed position as shown in FIGS. 9 and 10, one of these openings receive, and provide clearance for, the offset portion 94.

The above described arrangement is illustrative of a single one of many possible specific embodiments of the invention. Numerous and varied other arrangements can readily be devised in accordance with the principles disclosed herein by those skilled in the art without departing from the spirit and scope of the invention.

The embodiments of the invention in which an exclusive property or privilege is claimed are defined as follows:

1. A locking mechanism for a vehicle door or hatch comprising:

a casing including a pair of support plates fastened together in spaced relation and having mutually facing inner, parallel surfaces defining a space therebetween;

said casing having a T-shaped tongue portion including identical, spaced, congruent, T-shaped tongues along corresponding edges of said plates adapted to extend outwardly beyond the edge of a door into a strike fastened to a vehicle frame, said tongues having congruent central stems and relatively wider congruent heads at the outer ends thereof defining a pair of strike-engageable recesses in said casing under opposite ends of the heads;

a pair of flat, blade-like bolt members pivotally connected to said support plates, disposed in side-by-side coplanar relationship in the space between said support plates and in slidable, constrained relation with said inner, parallel surfaces, said bolt members having outwardly extending latch portions disposed side-by-side between said T-shaped tongues, said bolt members being pivotally movable to a closed position in which the latch portions thereof are extended into said recesses, said bolt members further being pivotally movable to open positions in which the latch portion thereof are retracted from said recesses into the space between said stems;

means interconnecting said bolt members for simultaneous movement between said closed and open positions;

spring means biasing said bolt members toward their said closed positions;

a slide member movably supported in said casing in position to engage at least one of said bolt members and effective when moved in one direction to move said bolt members toward their open position against the bias of said spring means;

said slide member having a transversely movable portion which is movable in a direction transverse to said one direction between positions determining locked and unlocked mode positions of said slide member;

a bolt actuator member movably supported in said casing and engageable with said transversely movable portion of said slide member when the slide member is in its said unlocked mode position, and not engageable therewith when the slide member is in its said locked mode position;

whereby movement of said slide member to its said unlocked mode position enables said actuator member to move said slide member in said one direction and thereby move said bolt members to their open position; and whereby further movement of said slide member to its said locked mode position disables said actuator from moving said slide member and said bolt members.

2. A locking mechanism according to claim 1 in which said means interconnecting said bolt members for simultaneous movement comprises interlocking elements on the respective edges of the bolt members, and said slide member and one of said bolt members are interconnected by an element extending from one of said members to the other.

3. A locking mechanism according to claim 1 in which said spring means comprises a spring member acting between said casing and said slide member, said spring member being mounted to move said slide member in a direction opposite said one direction.

4. A locking mechanism according to claim 1 in which said slide member comprises an elongated slide rod member longitudinally and rotatably journaled in said casing.

5. A locking mechanism according to claim 4 in which said transversely movable portion of said slide member comprises a transversely offset portion of said slide rod member which is transversely movable upon rotation of the slide rod member, said actuator member being engageable with said transversely offset portion in said unlocked mode position of the slide rod member and non-engageable therewith in said locked mode position of the slide rod member.

6. A locking mechanism according to claim 5 in which said slide rod member has at least one arm with means for connecting it to a manual locking element for turning said slide rod member between locked and unlocked mode positions, and said actuator member having at least one arm with means for connecting it to a manual actuating element for moving said bolt members between open and closed positions.

7. A locking mechanism according to claim 6 in which said bolt members, slide rod member, and actuator member are coplanar with one another within said space between said support plates, and at least one of said plates has an opening alongside said offset portion of said slide rod member to receive said offset portion when the slide rod member is in its said locked mode position.

8. A locking mechanism according to claim 7 in which said opening is positioned in said plate to enable said offset portion of said slide rod member to be rotated out of engagement with said actuator member only in the locked mode position of the slide rod member and in the closed position of the bolt members.

9. A locking mechanism according to claim 7 in which said mutually facing inner, parallel surfaces of said support plates constrain the offset portion of the slide rod member and prevent transverse movement thereof to thereby maintain said offset portion engaged with said actuator member when the slide rod member is in unlocked mode position and the bolt members are in open position.

10. A locking mechanism according to claim 7 in which said bolt actuator member comprises at least one flat, blade-like element pivotally connected to said casing in said space between said inner, parallel surfaces of said support plates.

11. A locking mechanism according to claim 6 in which one of said support plates has a slot parallel with said slide rod member, said slide rod member having a transverse arm portion extending through said slot to prevent rotation of said slide rod member when the bolt actuator member moves the bolt members to open position.

12. A locking mechanism according to claim 11 in which said transverse arm portion of said slide rod member is out of engagement with said slot when the slide rod member is moved to a position corresponding to the closed position of said bolt members, thereby enabling said slide rod member to be turned by the locking element without constraint by said slot.

* * * * *